US005617479A

United States Patent [19]

Hildebrand et al.

[11] Patent Number: 5,617,479

[45] Date of Patent: Apr. 1, 1997

[54] GLOBAL QUIETING SYSTEM FOR STATIONARY INDUCTION APPARATUS

[75] Inventors: Stephen Hildebrand, Arlington, Va.; Ziqiang Hu, Columbia, Md.

[73] Assignee: Noise Cancellation Technologies, Inc., Linthicum, Md.

[21] Appl. No.: 571,281

[22] Filed: Dec. 12, 1995

Related U.S. Application Data

[63] Continuation of Ser. No. 118,839, Sep. 3, 1993, abandoned.

[51] Int. Cl.[6] ..... G10K 11/16

[52] U.S. Cl. ..... 381/71

[58] Field of Search ..... 381/71, 94

[56] References Cited

U.S. PATENT DOCUMENTS

| | | | |
|---|---|---|---|
| 2,776,020 | 1/1957 | Conover et al. . | |
| 4,435,751 | 3/1984 | Hori et al. . | |
| 4,514,714 | 4/1985 | Kanoi et al. . | |
| 5,020,978 | 6/1991 | Nashif | 417/363 |
| 5,091,953 | 2/1992 | Tretter . | |
| 5,315,661 | 5/1994 | Gossman et al. | 381/71 |

OTHER PUBLICATIONS

"Active Control of Sound Radiating from a Vibrating Structure," V.V. Varadan et al. I.E.E.E., Jul. 1991.

Simpson and Luong, "Full–Scale Demonstration Tests of Cabin Noise Reduction Using Active Vibration Control," J. Aircraft, vol. 28, 1991.

O.L.Angevine, "Active Cancellation of the Hum of Large Electric Transformers," *Proceedings of Inter–Noise,* Jul. 20–22, 1992.

*Primary Examiner*—Forester W. Isen

*Attorney, Agent, or Firm*—Crowell & Moring

[57] ABSTRACT

The present invention relates generally to global noise or sound control and, more particularly, to the control or sound radiated from stationary induction apparatus such as power transformers and shunt reactors by use of active enclosures and active panels. The purpose of the invention is to markedly reduce the radiation of sound from the machine to all observation points in the surrounding field with a very lightweight, compact, non-airtight structure which does not impair maintenance or repair of the machine.

13 Claims, 20 Drawing Sheets

GLOBAL QUIETING SYSTEM FOR STATIONARY INDUCTION APPARATUS

This application is a continuation of application No. 08/118,839 filed Sep. 3, 1993, now abandoned.

BACKGROUND OF THE INVENTION

1. Field of the Invention

The present invention relates to a noise-reduction system for reducing the noise generated from the tank of a stationary induction apparatus such as a power transformer or a shunt reactor. It is a particular implementation of an "Active Acoustic Transmission Loss Box" described in U.S. patent application Ser. No. PCT/US92/08401 filed 8 Oct. 1992.

2. Background Art

Stationary induction apparatus such as power transformers and shunt reactors are used in utility substations and elsewhere for electric power transmission. These devices produce a low-frequency hum that is a source of noise pollution for persons working or living near the substations. The noise is due to magnetostriction of the core being transmitted to the tank (either directly or through the oil). The vibrating tank in turn radiates acoustic energy to the far field. The stationary induction apparatus in North America generate 120 Hz tones (plus harmonics of the 120 Hz fundamental).

Passive techniques have been tried to decrease noise of stationary induction apparatus with only limited success. One method requires surrounding the transformer or reactor with an expensive masonry building. Another approach discussed by Minoru Kanoi, et al., "Noise Reduction Device for Stationary Induction Apparatus," U.S. Pat. No. 4,514,714 dated Apr. 30, 1985, incorporated by reference herein, requires completely covering the tank with complex, multilayer sound-damping panels. Each of these panels also require finely tuned absorbers. Both of these approaches are expensive and limit maintenance and repair. In addition, the passive panels are not suitable for use as a retrofit. Noise reduction is limited to only about 10 dBA with these passive techniques.

Active techniques also have been tried to decrease noise of stationary induction apparatus with only limited success. For example, Conover, "Noise Reducing System for Transformers," U.S. Pat. No. 2,776,020, Jan. 1, 1957, incorporated by reference herein, mounted an array of loudspeakers along one side of a transformer and was able to reduce the noise from one side of the transformer for brief periods of time, at which time his circuitry required readjustment. More recently Angevine "Active Cancellation of the Hum of Large Electric Transformers," Proceedings of Inter-noise '92, July 20–22, 1992, Toronto, Canada, incorporated by reference herein, repeated this experiment using an array of 8 loudspeakers, and two 4-channel, adaptive controllers to adjust the signals to the loudspeakers. Angevine used loudspeakers located a few meters from the transformer, and microphones about 30 m from the transformer. It is very difficult to obtain adequate noise measurements with the microphones so far removed from the transformer. Low background noise is required to obtain adequate signal-to-noise ratios. Small amounts of wind or small changes in temperature will degrade the transfer function measurement. Angevine reports limited reduction over a narrow angle (30°) or less. Angevine reports degraded performance with wind or thermal changes. This approach is of little commercial utility because it does not provide continuous, global cancellation of the transformer noise, and is physically obstructive.

Another active method that has been tried with limited success is the use of vibrators attached to the tank walls as discussed in U.S. Pat. No. 4,435,751. The difficulty with this approach is that the tank vibration can be decreased locally where the vibrator is attached, but the vibration invariably increases elsewhere on the tank when canceling the first harmonic. This difficulty is due to a volumetric change in the transformer core at the fundamental frequency of the magnetostriction. Since the transformer oil is essentially incompressible, decreasing the vibration at one point on the tank likely results in increasing the vibration in other uncontrolled areas of the tank. Controlling the entire tank surface is not practical, with the net result that global noise reduction is not obtained.

What is required to obtain continuous, global cancellation of the transformer noise is a particular implementation of an "Active Acoustic Transmission Loss Box" as described by Fuller, McLoughlin and Hildebrand in PCT Application PCT/US92/08401 filed 8 Oct. 1992 (incorporated by reference herein), together with a multiple-interactive, self-adapting controller, as described by Tretter, "Repetitive Phenomena Cancellation Arrangement with Multiple Sensors and Actuators," U.S. Pat. No. 5,091,953 dated Feb. 25, 1992 (incorporated by reference herein). As described by Fuller et al, active enclosures and active panels can be used to reduce noise from machinery such as power transformers. However, there are certain unique and unusual modifications that are required for the "Active Acoustic Transmission Loss Box" to be commercially successful for the control of noise from power transformers and similar machinery.

BRIEF STATEMENT OF THE INVENTION

The invention described herein consists of a system of actuators and sensors attached to a transformer and connected to a multiple-interactive, self-adaptive controller, with said system producing large global, far-field sound reductions at reasonable cost. The method for determining where to place the actuators and sensors is a claim of the invention. Also claimed are preferred embodiments of actuators necessary to achieve said sound reduction, which are suitable for use outdoors exposed to the environment for many years.

OBJECTS OF THE INVENTION

It is accordingly an object of the present invention to achieve high attenuation of radiated sound from stationary induction apparatus without the disadvantages of the prior art. This is achieved with a particular implementation of an "Active Acoustic Transmission Loss Box" utilizing both an active-enclosure and active-panels.

It is another object of the invention to achieve very high global (here global means throughout an extended volume) reduction of sound with the above active panels constructed from very lightweight thin material, and the sides of the tank itself used as an active-enclosure to reduce radiated noise.

It is also an object of this invention to achieve very high global sound attenuation with active-panels which do not completely surround the machinery (i.e., are not airtight), rather they have significant air gaps or holes located between the active panels.

It is another object of this invention to achieve very high global sound attenuation with sensors located very close or on the surface of the transformer or machinery, in order to mitigate otherwise crippling noise due to the environment (e.g., wind or road noise), or adjacent machinery (e.g., adjoining transformers).

It is another object of this invention to achieve very high global sound attenuation with a multiple-interactive, self-adapting controller which has the ability to automatically recalibrate on-line (i.e., on-line system identification) to remain effective with large changes in load to the machinery, or large changes in environmental factors (e.g., temperature or humidity).

It is still another object of this invention to achieve very high global sound attenuation with actuators and sensors located on the top, sides and bottom of the transformers, as necessary to obtain a large global noise reduction.

It is a further object of this invention to achieve said reductions using sensors consisting of microphones measuring sound pressure, accelerometers measuring tank vibration, or a combination of microphones and/or accelerometers measuring sound intensity with appropriate signal processing.

It is yet another object of this invention to provide a method of optimizing the noise attenuation of an induction apparatus by measuring sound intensity, creating a plot from said measurements and actively quieting said induction noise based on said plot.

These and other objects will become apparent to those reasonably skilled in the art when reference is made to the accompanying drawings in which.

Figure 15A:
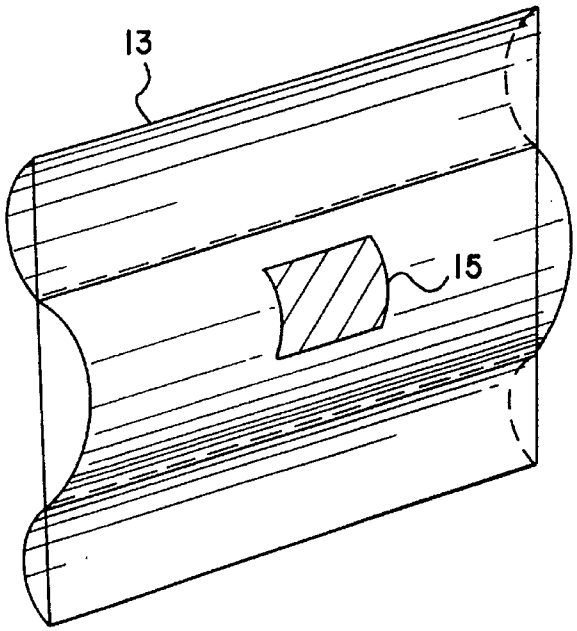
Figure 15B:
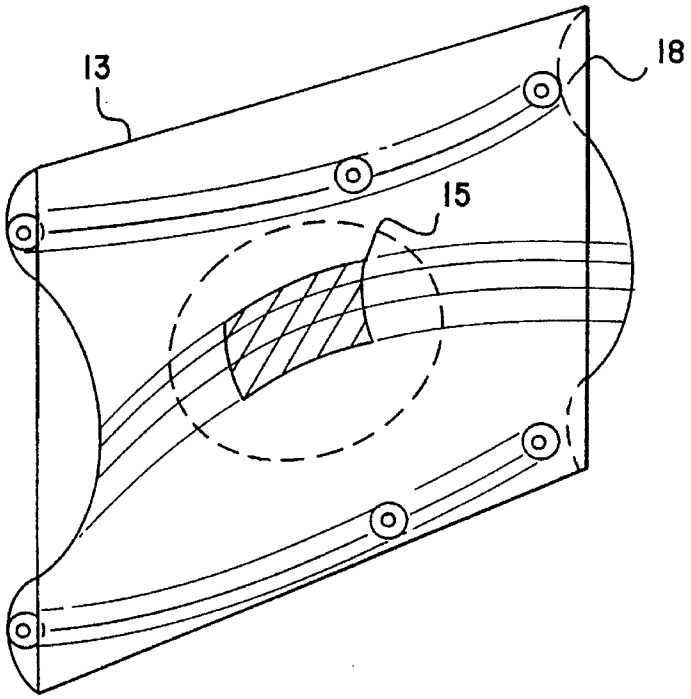

FIGS. 15*a* and 15*b* show how an active panel is tuned for optimal performance.

Figure 16:
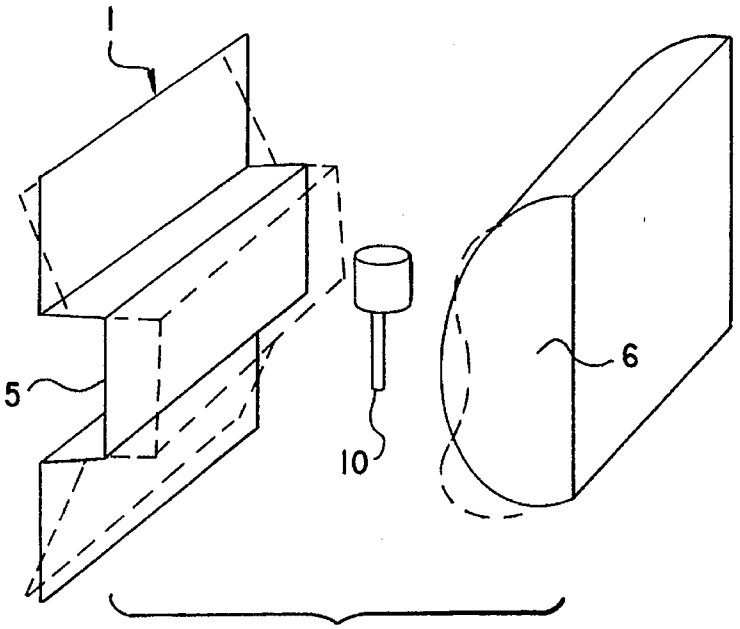

FIG. 16 is a cut-away view of a rib of a transformer tank with an adjacent view of an active panel. This figure shows a typical interaction between a transformer tank and an active panel.

Figure 2A:
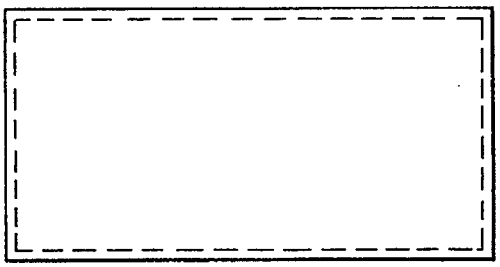
FIG. 2 shows three views of a transformer tank.
Figure 2B:
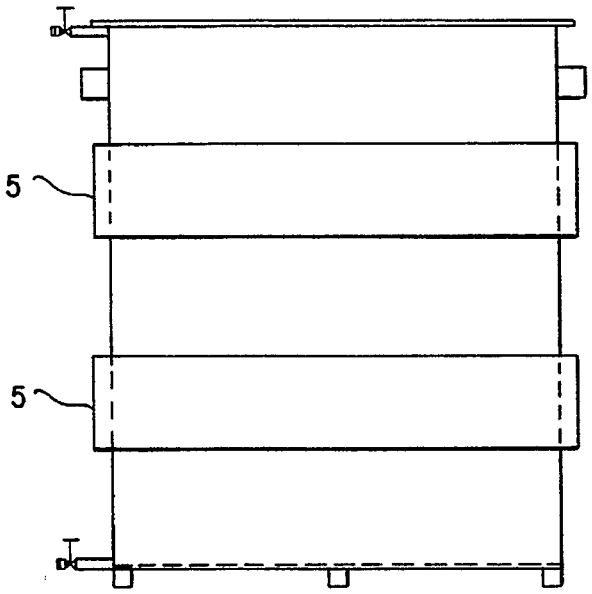
Figure 2C:
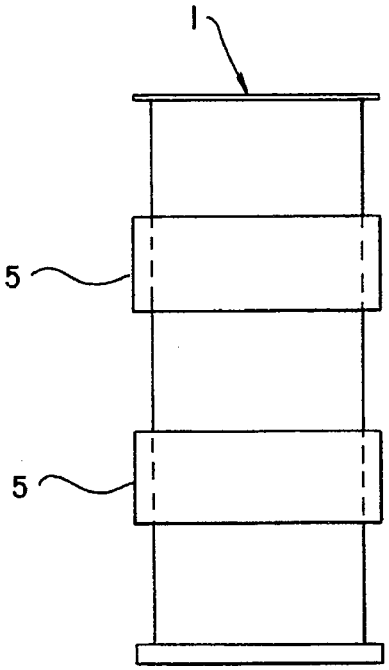
Figure 17:
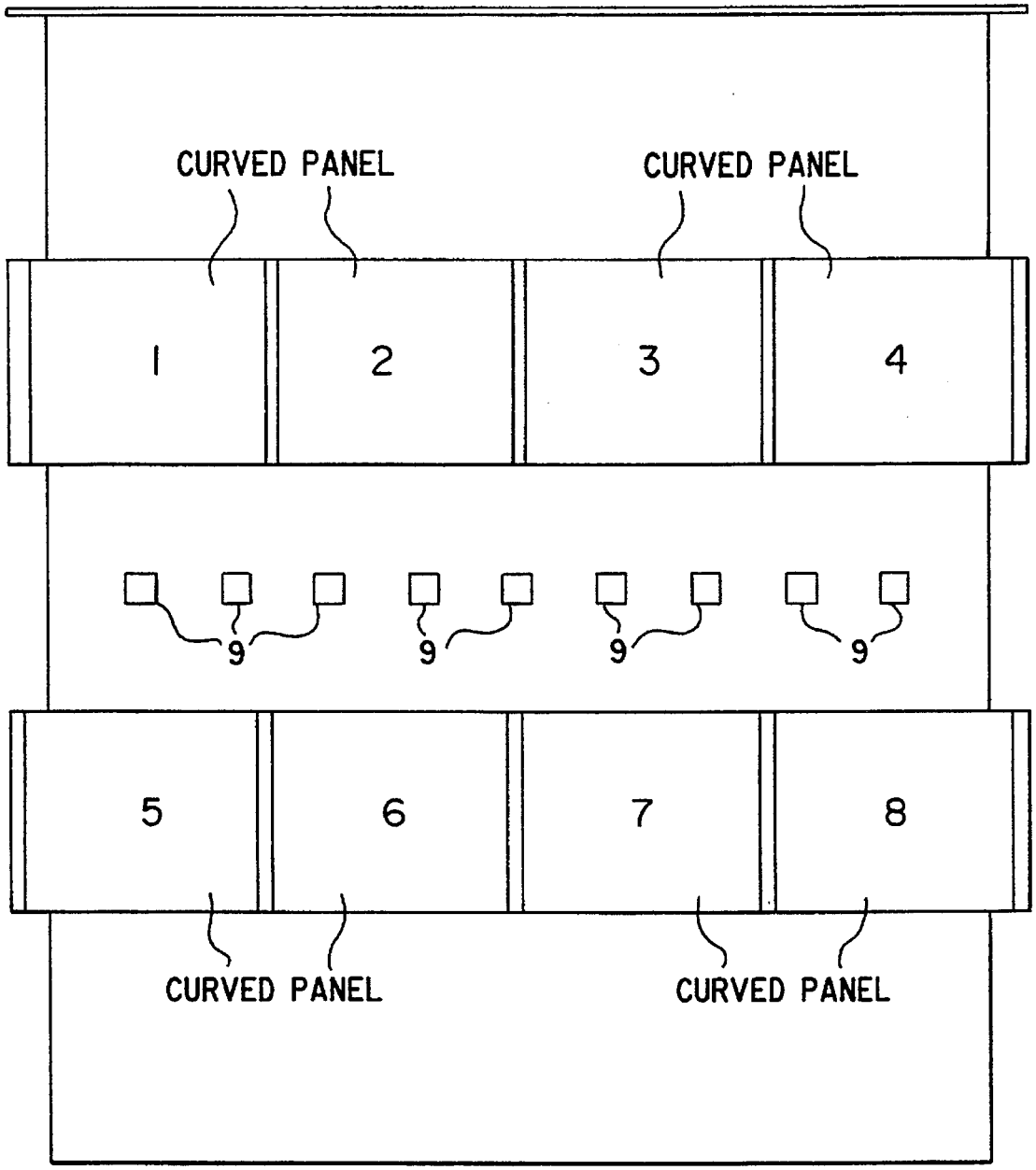
Figure 18:
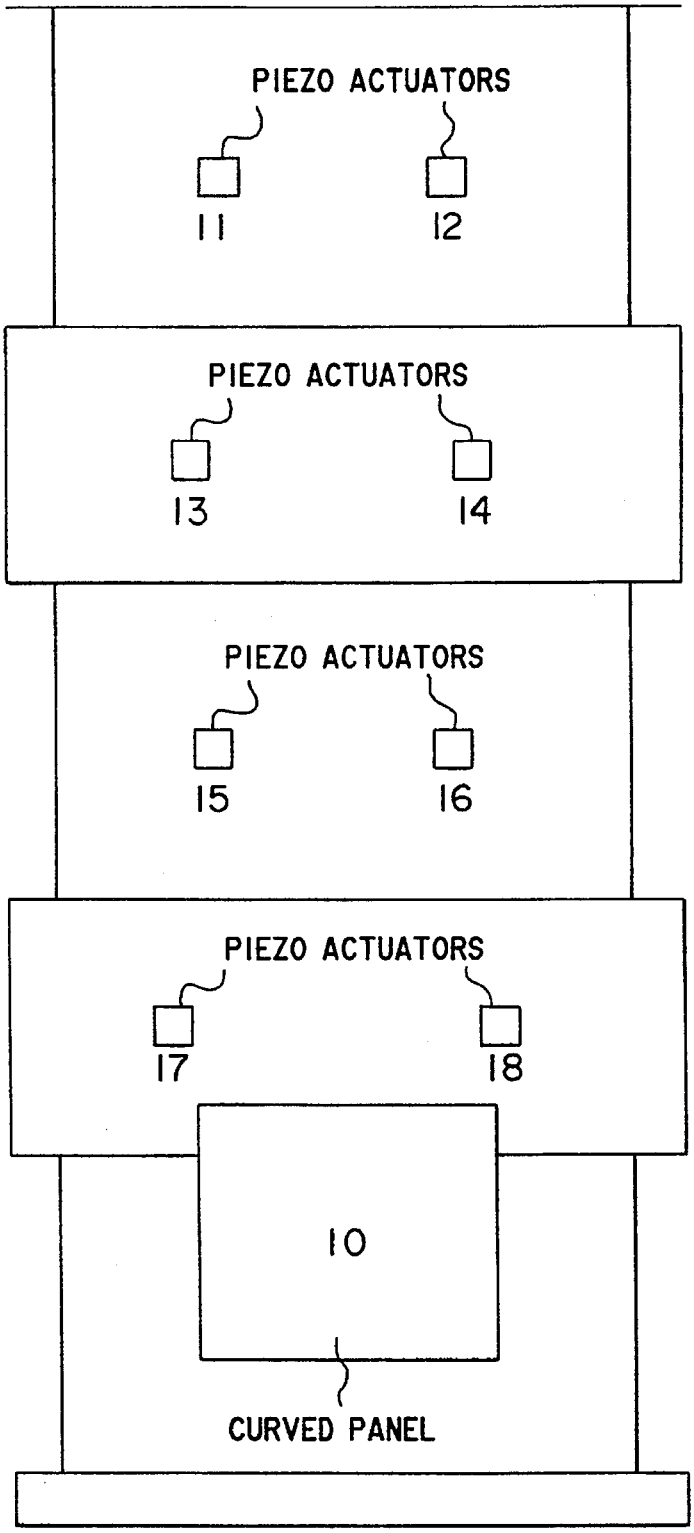

FIGS. 17 and 18 show a preferred layout of piezoceramics and active panels for the east and north sides of the transformer shown in FIG. 2.

Figure 19:
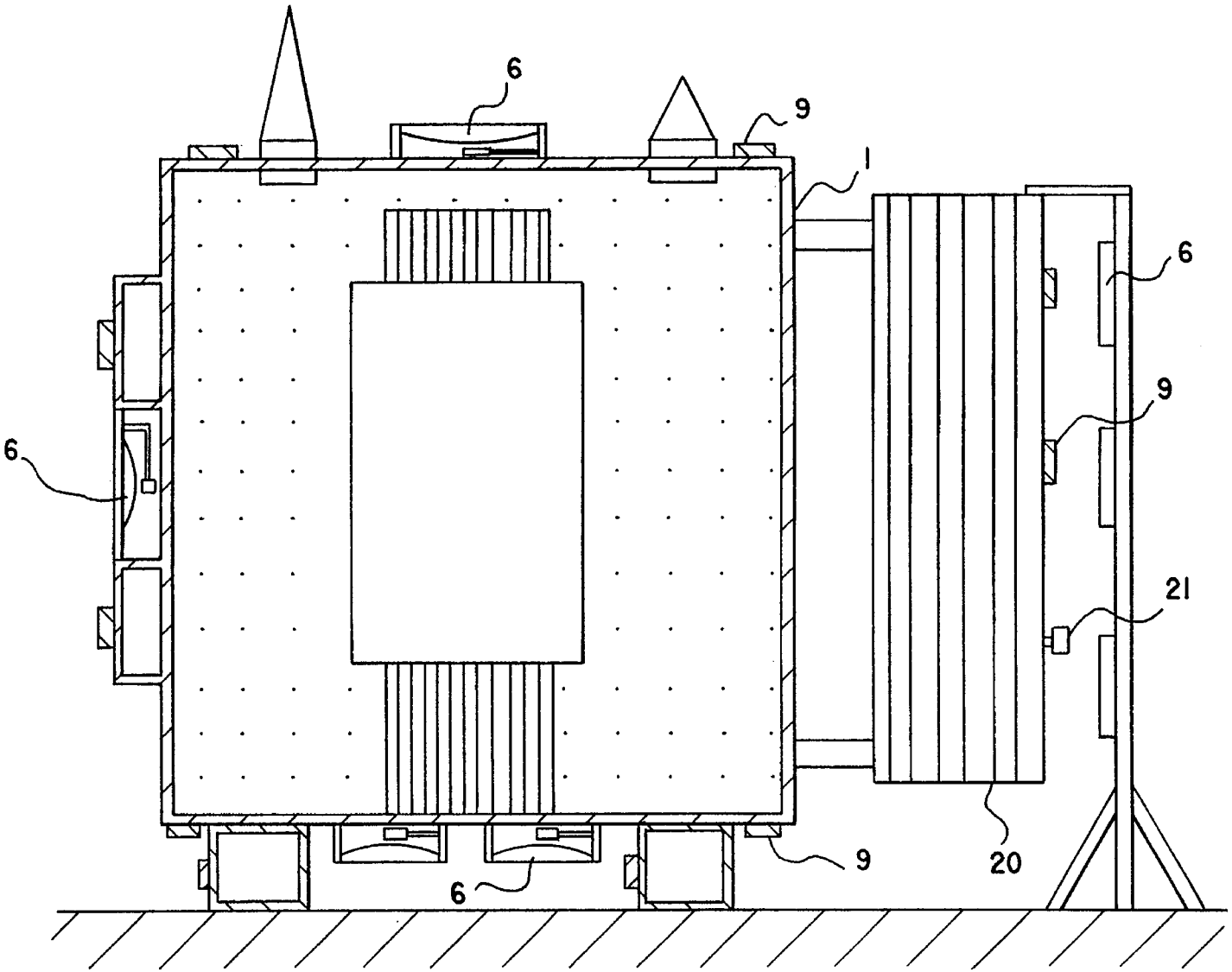

FIG. 19 shows a cross-section of a different transformer tank design. Note the supports between the tank and the foundation. FIG. 19 shows some typical alternative locations for the piezo-actuators and active panels, including the use of actuators and sensors to quiet radiator noise.

Figure 20:
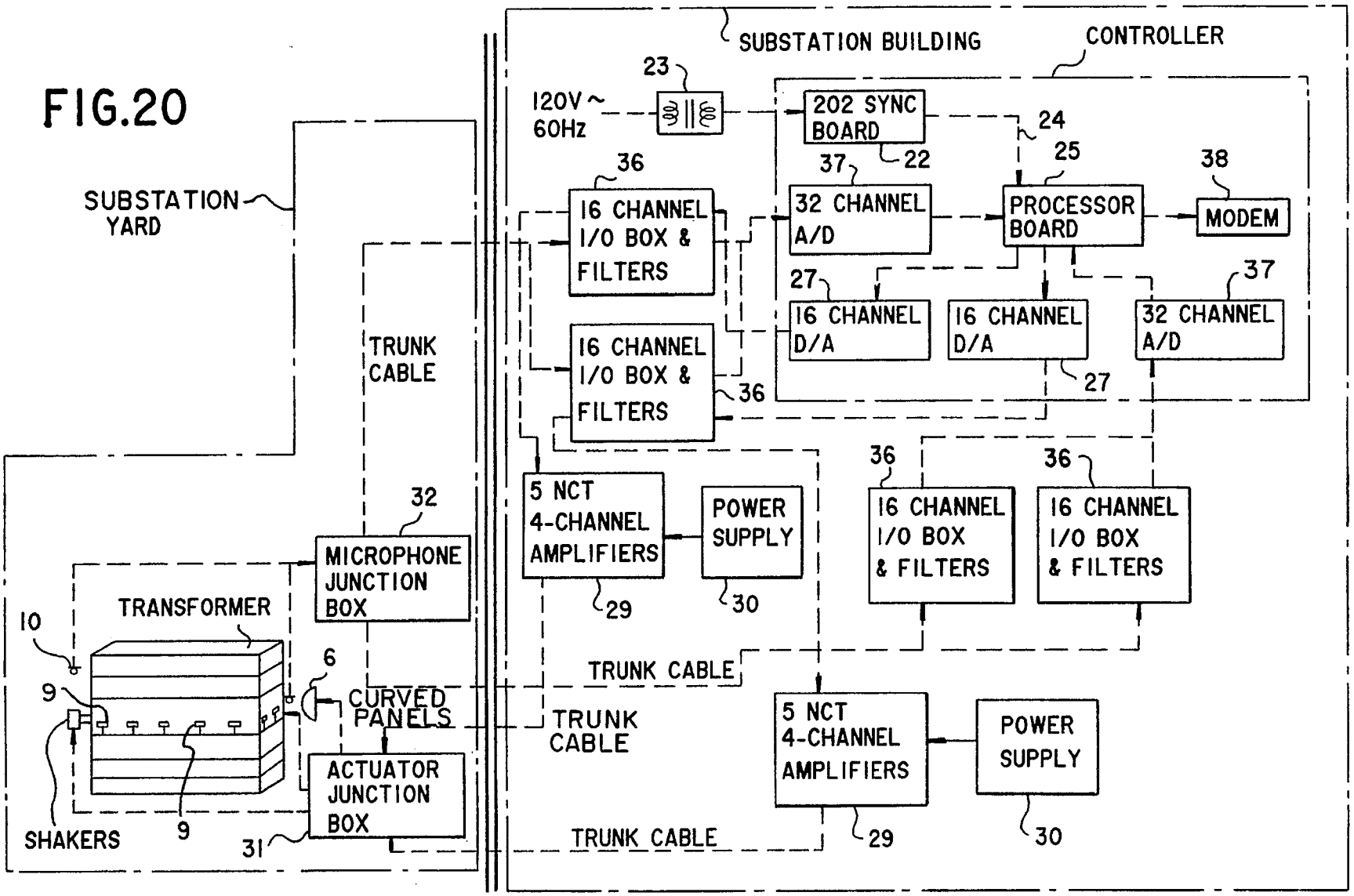

FIG. 20 shows a block diagram of the complete active control system.

Figure 21:
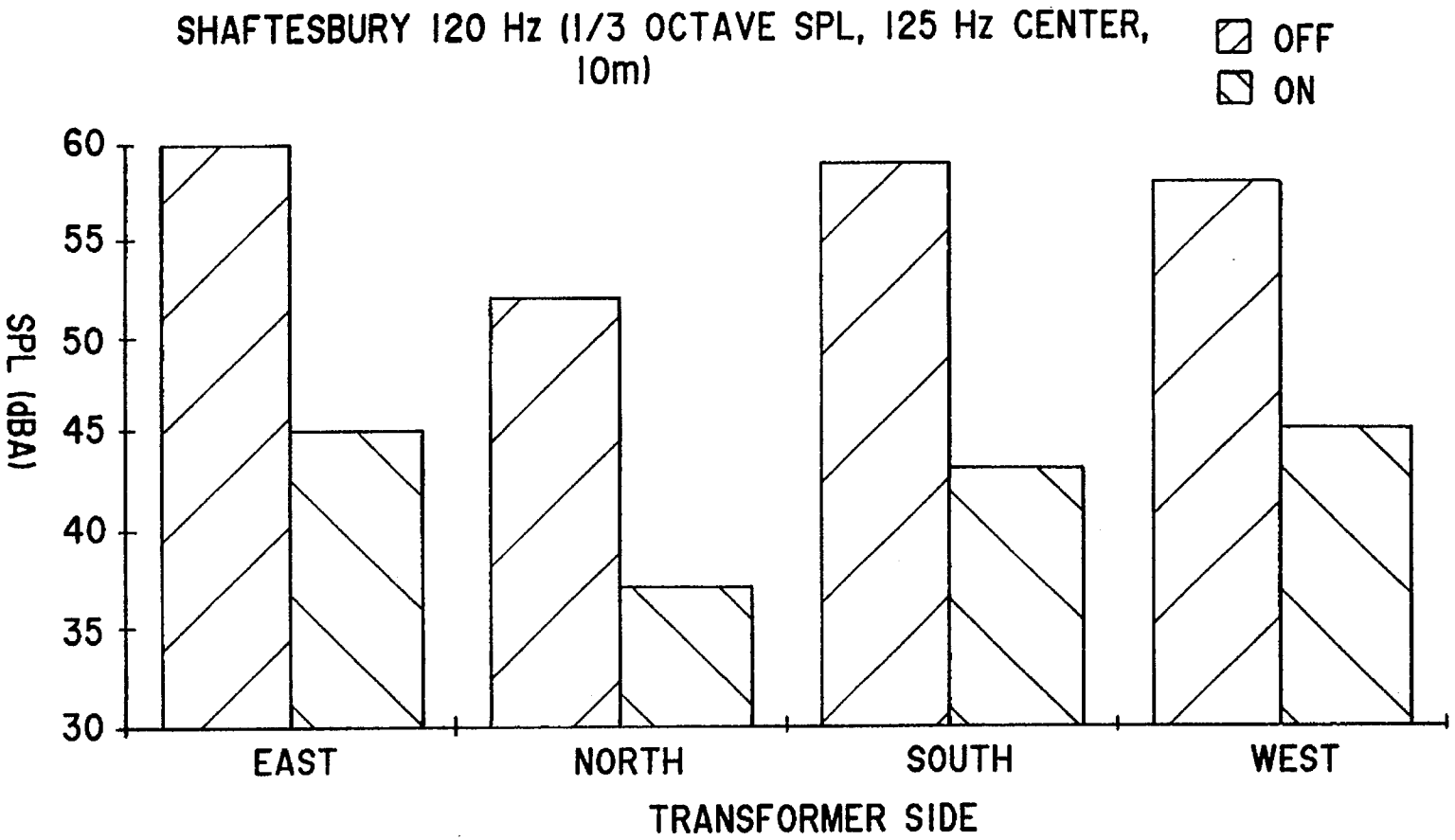
Figure 22:
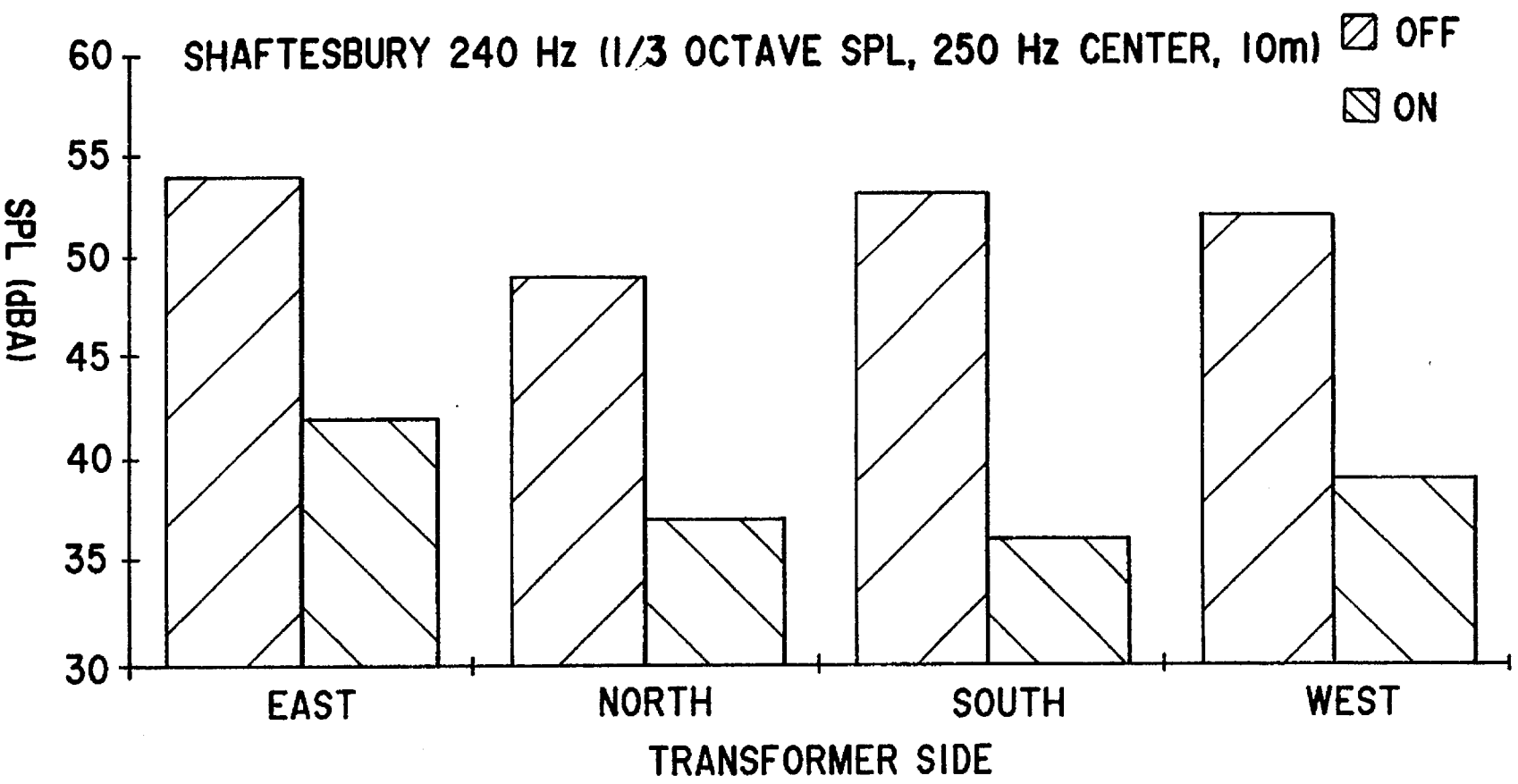

FIGS. 21 and 22 show the noise reductions obtained with active control system installed on the transformer for which the tank is illustrated in FIG. 2.

Still other objects and advantages of the present invention will become readily apparent to those skilled in the art from the following detailed description in which has been shown and described only the preferred embodiments of the invention by way of illustration of the best mode contemplated for carrying out the invention. As will be obvious this invention is capable of other and different embodiments and its several details are capable of modifications in several obvious ways without departing from the invention. Consequently the drawings and description are to be regarded as merely illustrative in nature and not as restrictive.

Figure 1:
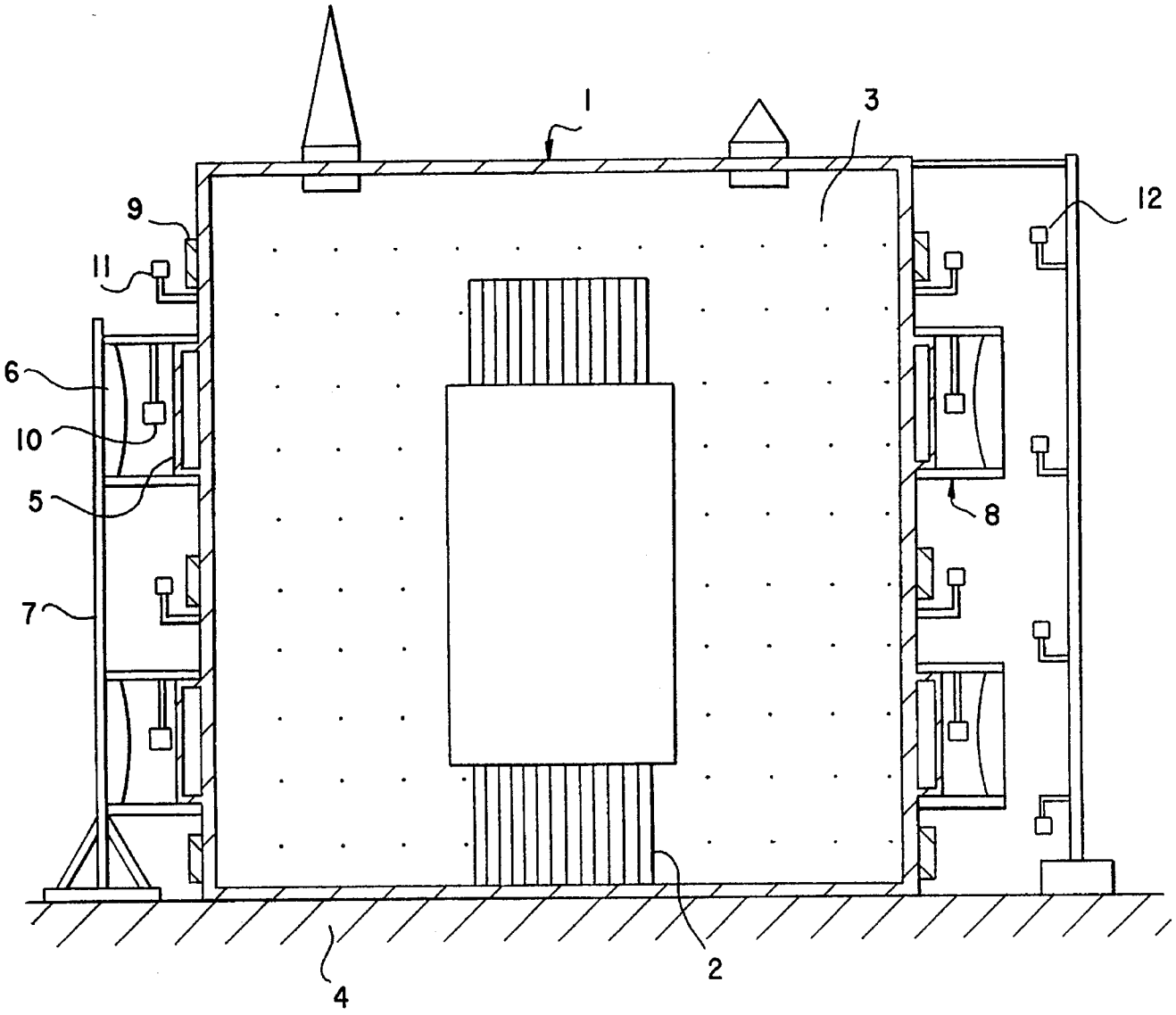
FIG. 1 is a cross-sectional view of a transformer showing actuators used for the active enclosure and active panels, and microphone sensors.

Referring now to the drawings wherein like reference numerals are used throughout the various views to designate like parts, and more particularly to FIG. 1; 1 denotes a transformer tank and 2 denotes the transformer core and core windings. Filling the tank 1 and surrounding the core 2 is the transformer oil 3. The transformer tank 1 rests on the foundation, 4. Typical side stiffeners 5 are shown in four places.

A typical active control system configuration is shown in FIG. 1. A side view of active panels, 6 is shown in four places. These are supported from a stand 7 or attached via support 8 directly to the transformer. A side view of the piezo-actuators, 9 is shown in six places. These are attached directly to the tank 1. Several microphones are also shown. One microphone 10 is located between the active panel 6 and the rib 5. Another 11 is mounted directly to the tank. Another microphone 12 is mounted on its own stand.

Figure 3:
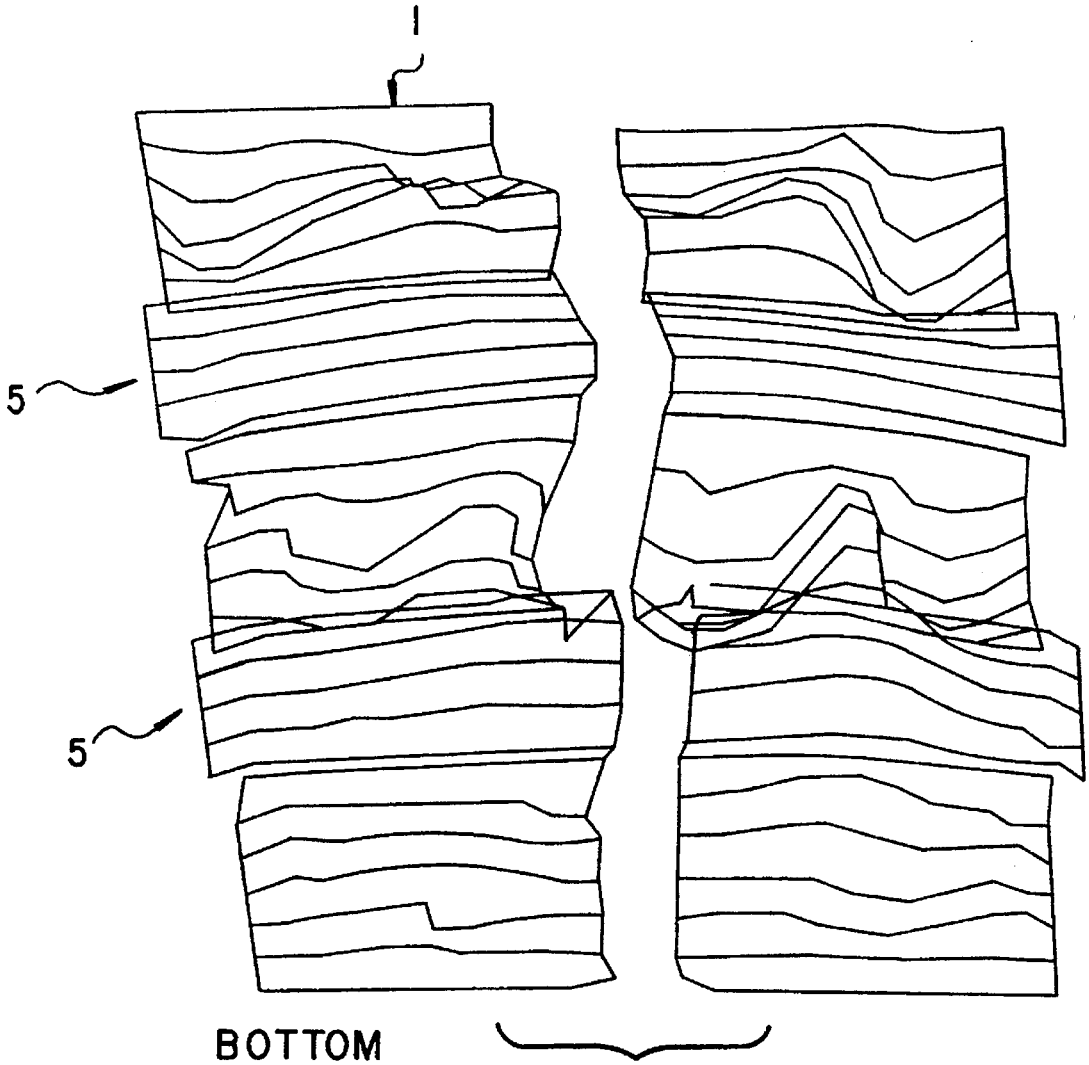
FIG. 3 shows a vibration test result for the east side of the transformer tank shown in FIG. 2 at 120 Hz.
Figure 4:
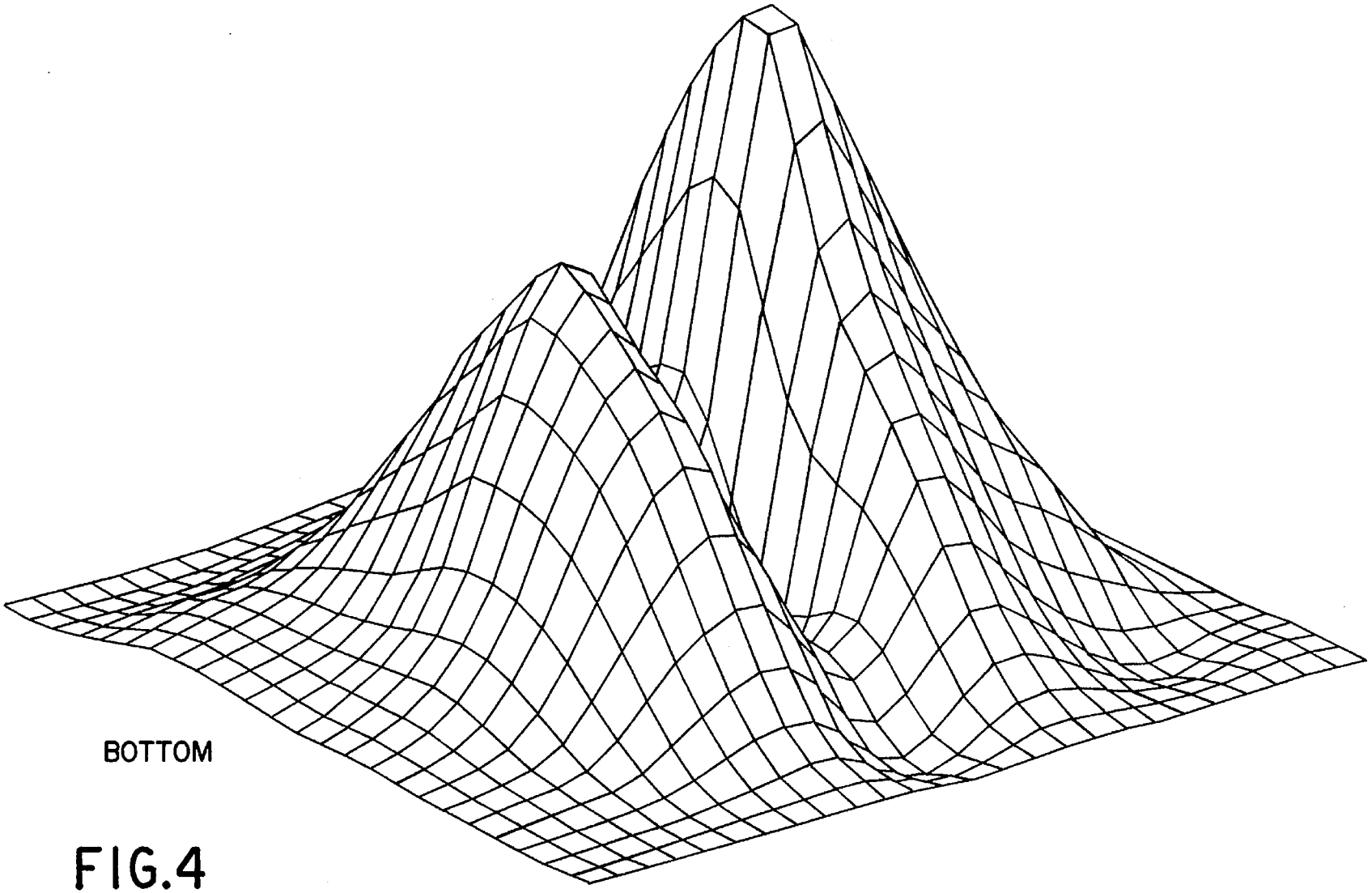
FIG. 4 shows the sound intensity for the east side of the transformer tank shown in FIG. 2 at 120 Hz.
Figure 5:
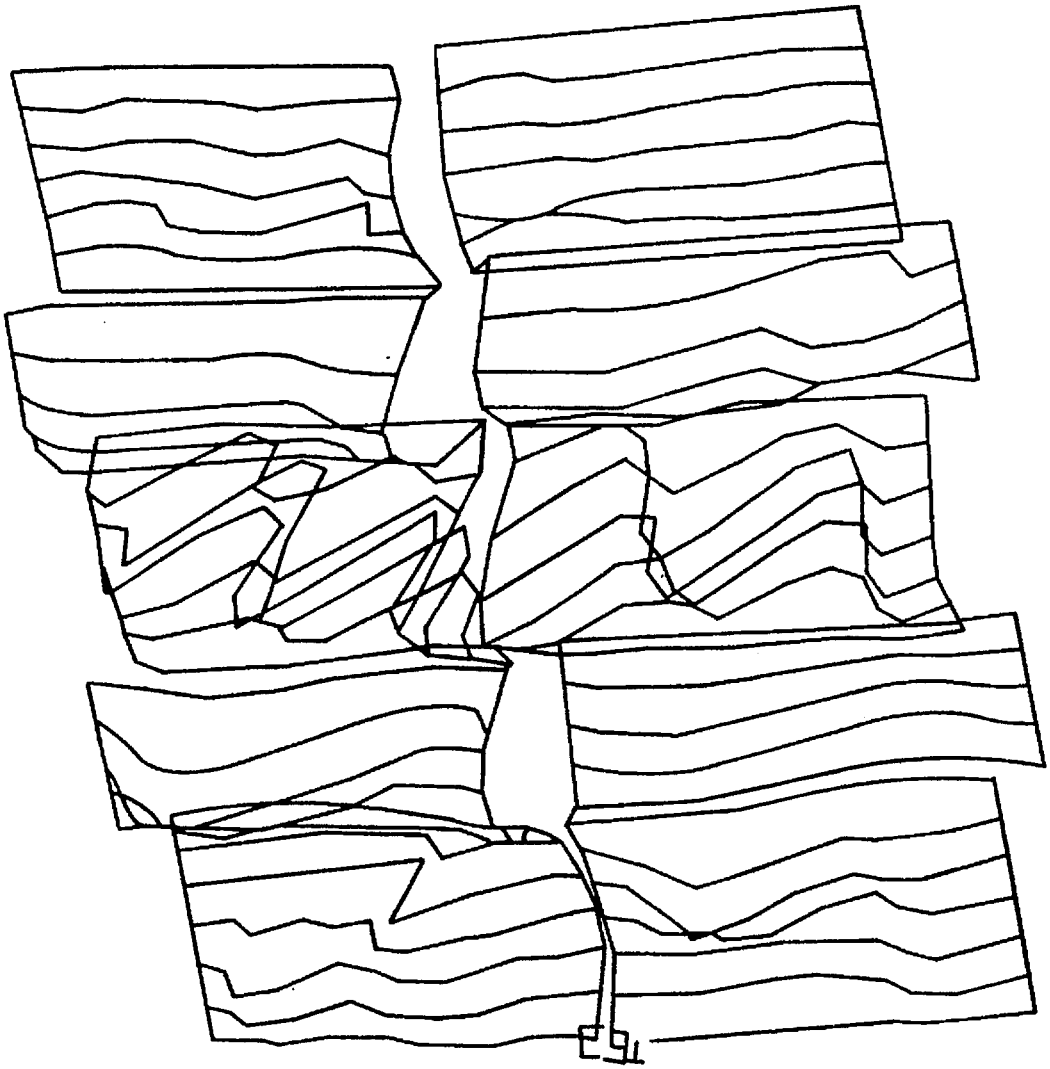
FIG. 5 shows a vibration test result for the east side of the transformer tank shown in FIG. 2 at 240 Hz.
Figure 6:
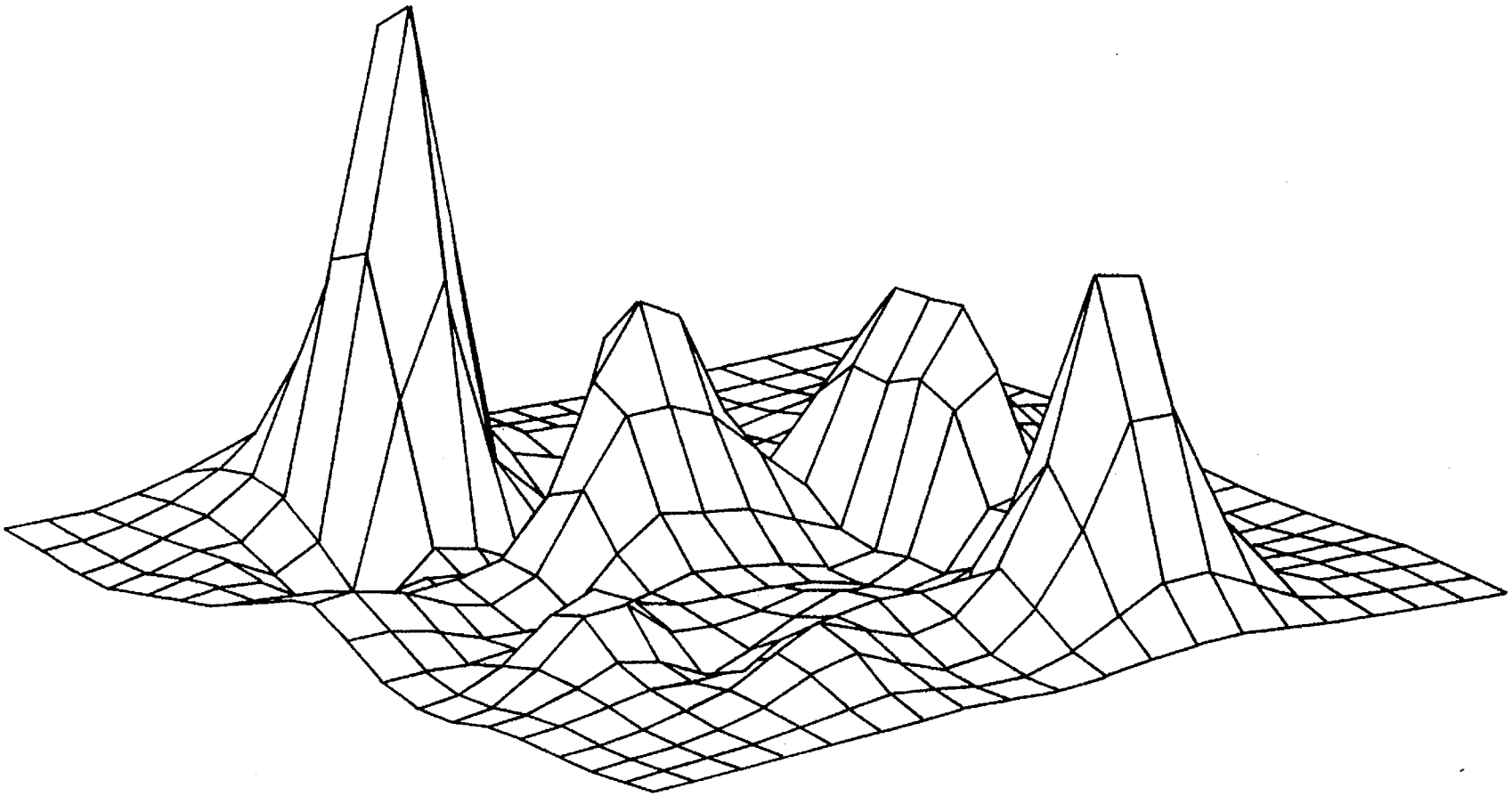
FIG. 6 shows the sound intensity for the east side of the transformer tank shown in FIG. 2 at 240 Hz.

FIG. 2 shows a typical transformer tank 1. This tank is about 8 ft. wide by 4 ft. deep and 10 feet tall, and is for a 7.5 MVA transformer. In order to determine the manner it is producing noise, an "operating-deflection-shape" is taken for each side of the transformer. Specifically, one accelerometer is held stationary (e.g., placed on a corner of one side of the tank 1), and a second accelerometer is used to "scan" the surface of the tank 1. That is, the magnitude and phase relative to the reference accelerometer is measured every few inches along the surface of the transformer tank 1. This measurement is performed with the primary-side of the transformer energized and the secondary-side under normal load. The resulting measurements are broken into frequency components, and the resulting spatial wave forms of the surface of the tank are determined. A view of the east side of the tank 1 motion at 120 Hz is shown in FIG. 3. This figure is a "snapshot" of the peak motion of the surface of the tank at 120 Hz, frozen in time. A series of horizontal lines representing the surface of the tank are shown. These horizontal lines would appear as straight lines on the undeformed surface. There is a gap along the vertical centerline because the left and right sides were measured separately and pieced together. Notice how both horizontal ribs 5 appear to be bulging outward. They both "bulge" inward 180° later in phase. This vibration data can be used to calculate the radiated sound field, using either the Rayleigh Integral (by treating each side of the transformer as if it were in an infinite baffle) or the Boundary-Element-Method. The sound intensity for the east side was calculated at a few inches from the surface of the tank using the FIG. 3 measurement data and the Rayleigh Integral, and the results are shown in FIG. 4. The sound intensity at the same distance from the east side was also measured with virtually identical results. The two "bulges" in FIG. 4 correspond to the horizontal ribs. Clearly the rib motion is the primary acoustic source at 120 Hz. The operating deflection shape for the east side at 240 Hz is shown in FIG. 5, and the corresponding predicted sound intensity is shown in FIG. 6. For the east side at 240 Hz, both the ribs 5 and the tank 1 between the ribs 5 are significant sources of acoustic energy.

Figure 7:
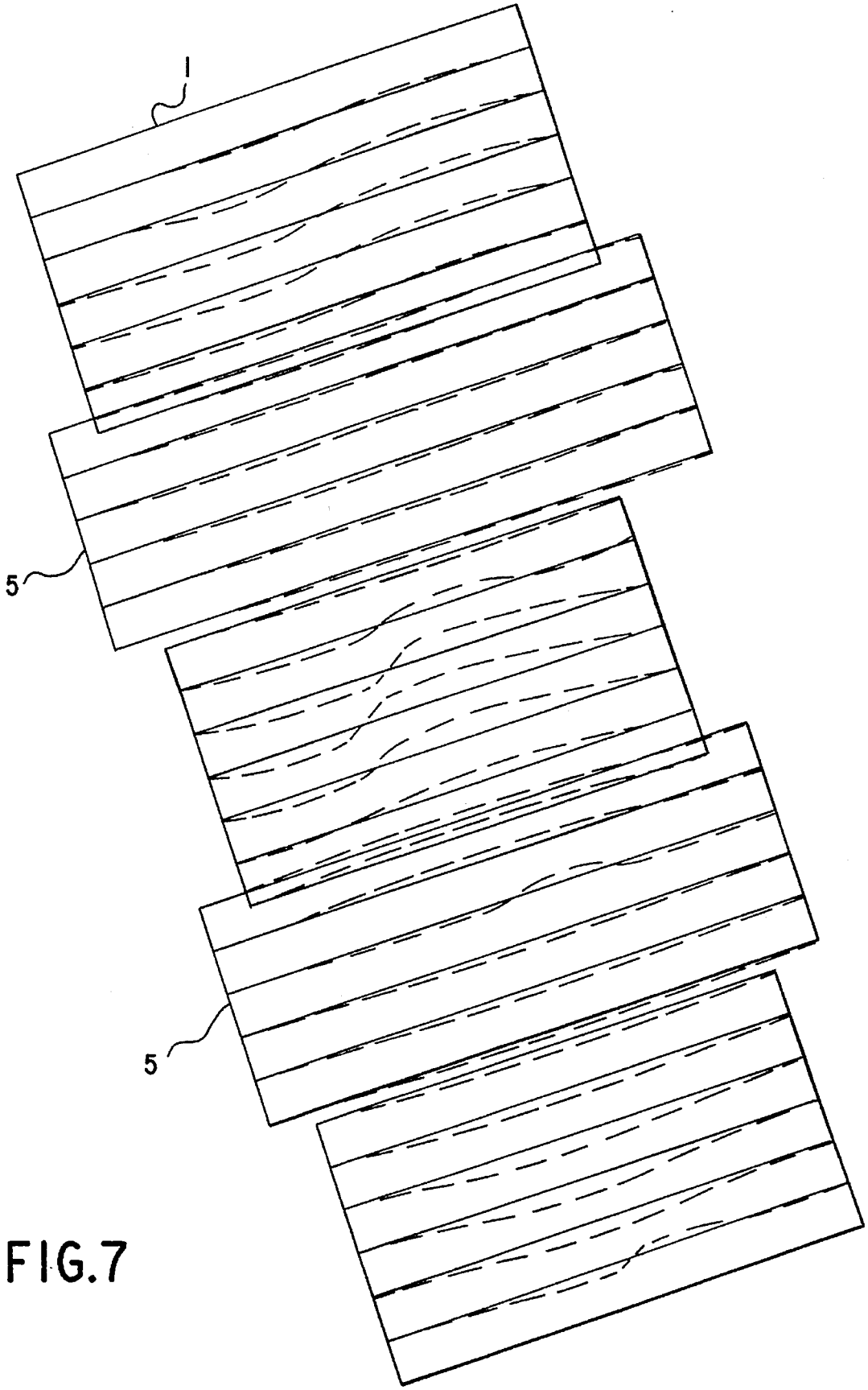
FIG. 7 shows a vibration test result for the north side of the transformer tank shown in FIG. 2 at 120 Hz.
Figure 8:
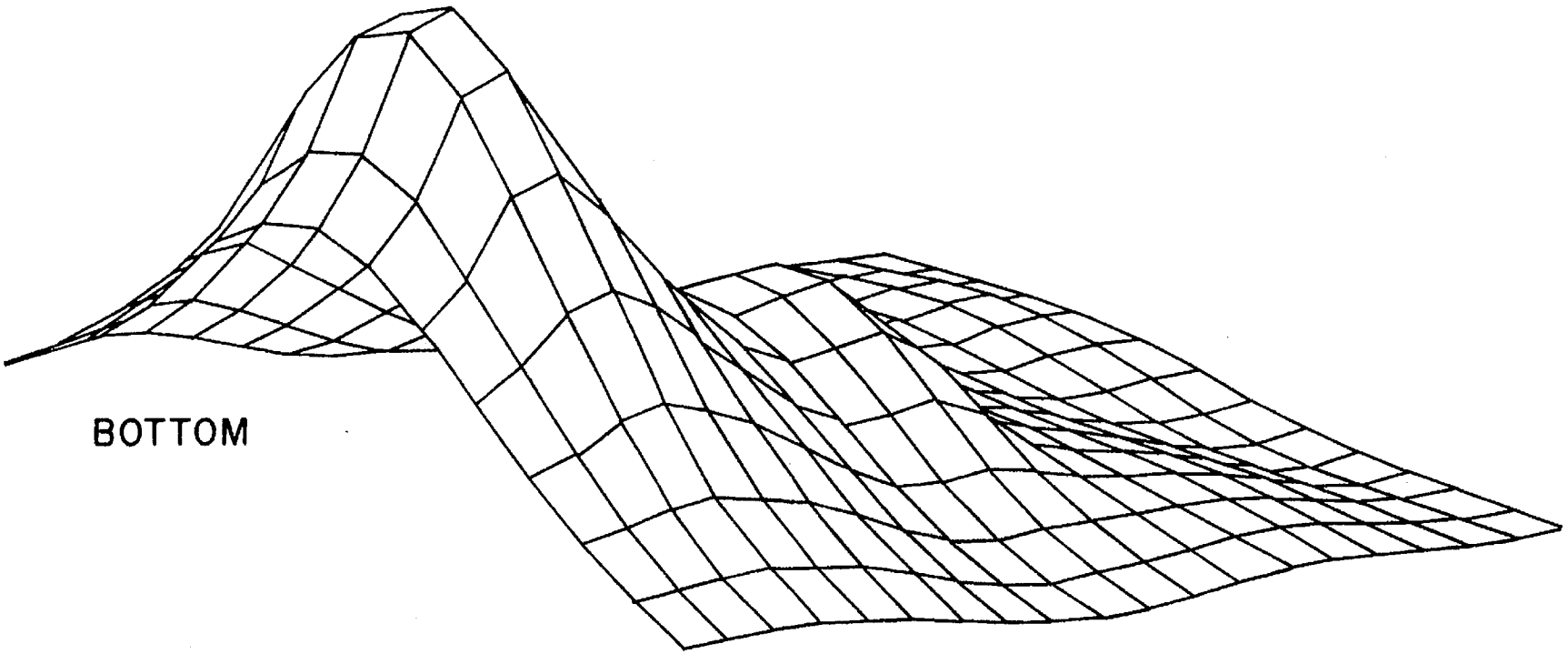
FIG. 8 shows the sound intensity for the north side of the transformer tank shown in FIG. 2 at 120 Hz.
Figure 9:
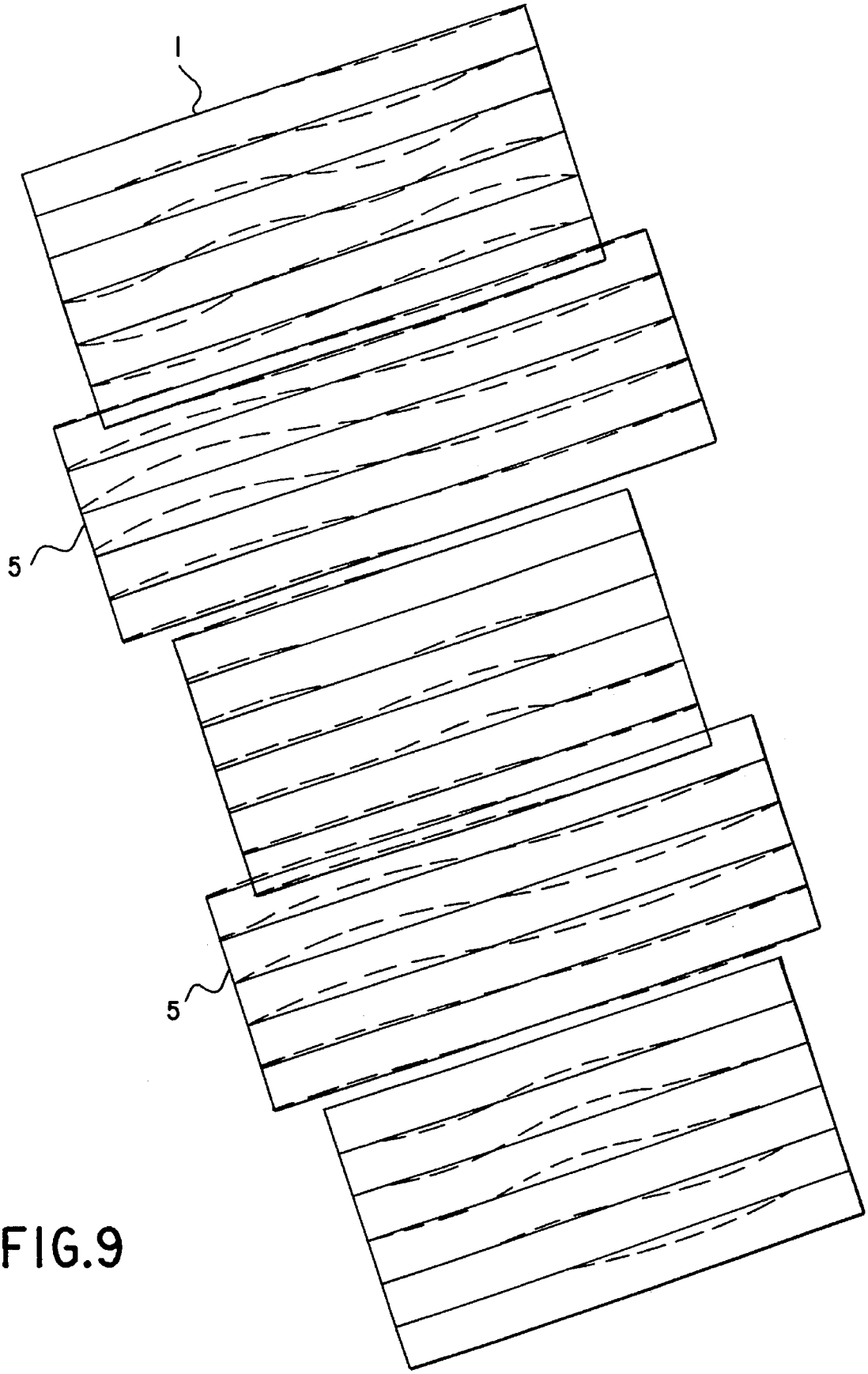
FIG. 9 shows a vibration test result for the north side of the transformer tank shown in FIG. 2 at 240 Hz.
Figure 10:
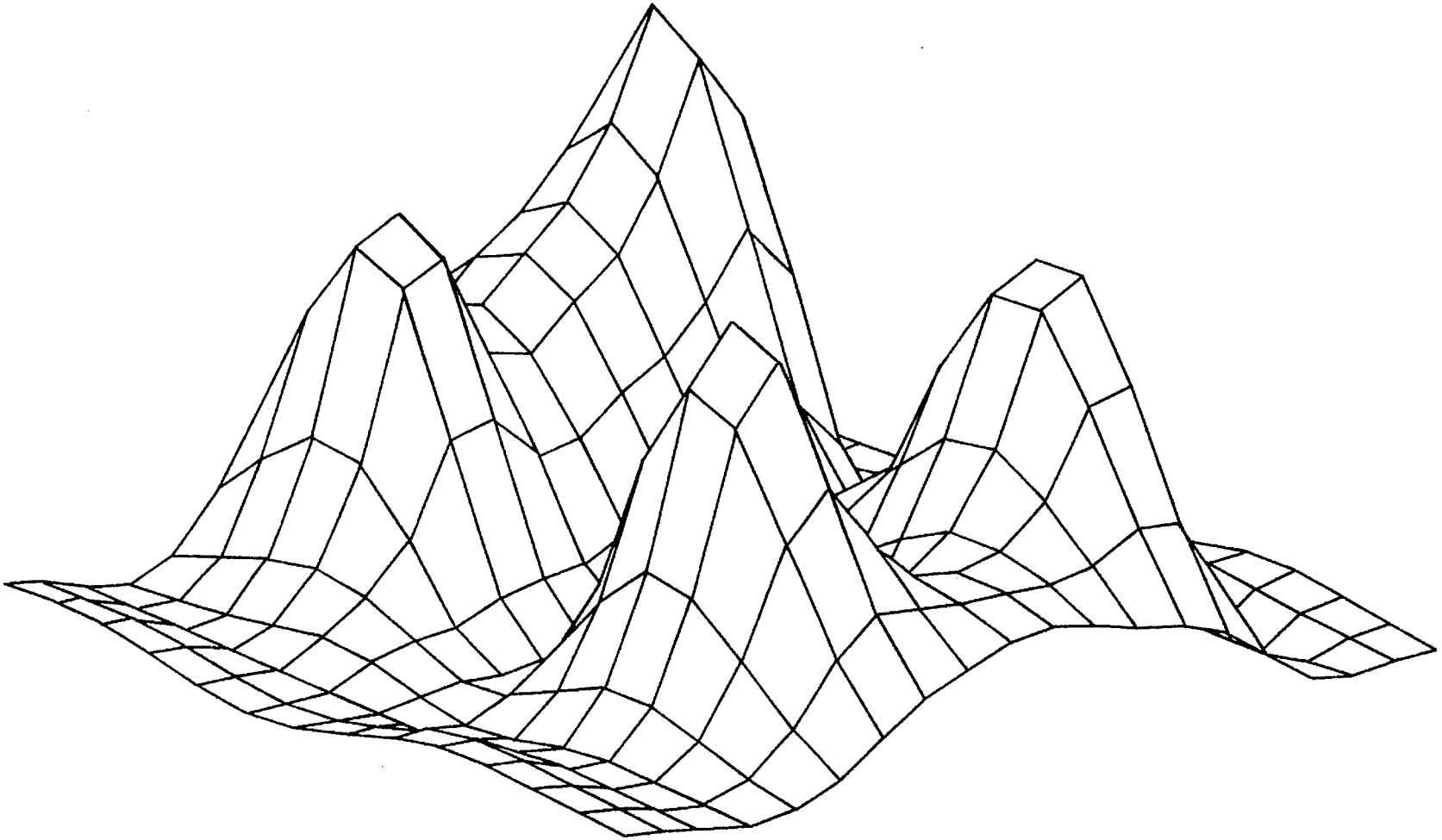
FIG. 10 shows the sound intensity for the north side of the transformer tank shown in FIG. 2 at 240 Hz.

This process was then repeated for the north side of the tank shown in FIG. 2. The operating deflection shape for the north side at 120 Hz is shown in FIG. 7, and the calculated sound intensity is shown in FIG. 8. The bottom of the tank 1 on the north side is a primary acoustic source at 120 Hz. The operating deflection shape for the north side at 240 Hz is shown in FIG. 9, and the calculated sound intensity is shown in FIG. 10. The two ribs 5 of the tank 1 on the north side are the primary acoustic source at 240 Hz.

The process was repeated for the west and south sides. Higher harmonics (i.e., 360 Hz, 480 Hz, etc.) could also have been evaluated in a similar manner, but it was concluded that the higher harmonics were not significant acoustic sources for this transformer.

Understanding the transformer tank as an acoustic source as described above is a vital first step in developing an active control strategy. Previous active-control approaches utilizing loudspeakers and microphones distant from the transformer failed due to their inability to recognize the importance of tightly coupling the anti-noise sources to the noise sources. By "tightly couple" it is meant for the anti-noise source to match as close as possible the location, distribution and level of the noise source. Tight coupling is essential in active control to obtain global reductions with minimal cost. Of course, this first requires performing baseline measurements as discussed above to understand the transformer tank as an acoustic source, so the location, distribution and level of anti-noise sources can be determined. The method of performing baseline measurements for locating actuators is an aspect of this invention.

For controlling transformer noise, the best coupling is obtained by attaching actuators directly to the transformer tank, such as piezoceramics. However, a special precaution is necessary for controlling the first harmonic of the transformer noise (120 Hz). This is because magnetostriction in the core causes a volumetric change of the core. Thus the core is effectively a displacement source at the first harmonic. Since the transformer oil is incompressible, the displacement source of the core transfers directly to the tank, so that the tank becomes a large displacement source. Controlling the vibration of this large displacement source is not practical—an excessive amount of force would be required (i.e., there would be a lack of sufficient "control authority"). Previous attempts at controlling the first harmonic failed because they tried to control the tank vibration. The satisfactory approach is to use active panels mounted close but not touching the tank. These active panels act as tuned absorbers which capture the acoustic energy before it can be radiated to the far-field.

Figure 11:
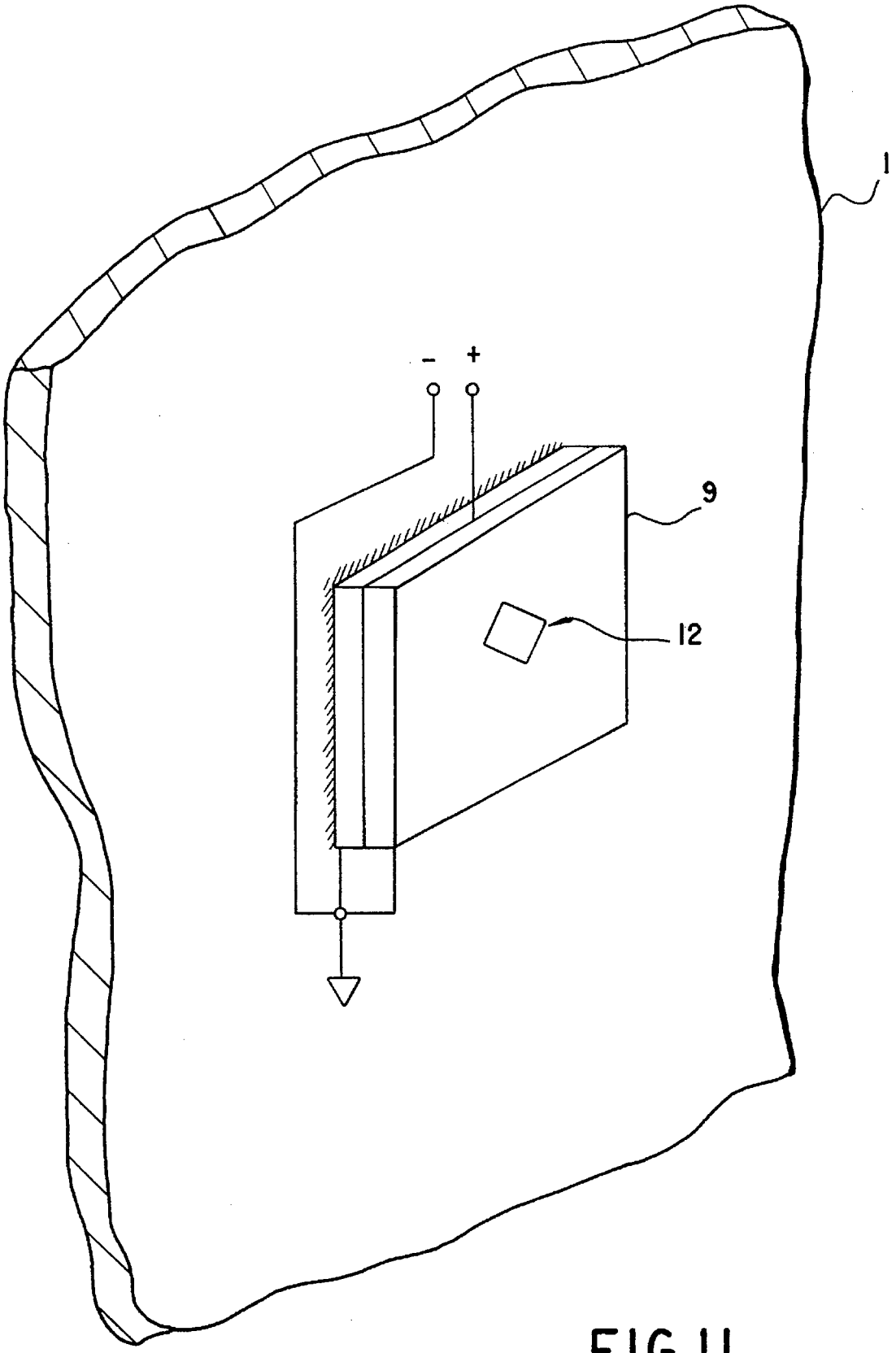
FIG. 11 shows a detailed view of a multilayer ceramic with a cut-away view of the tank wall such that the tank wall acts as an active enclosure.

FIG. 11 shows a detailed view of the piezo-actuator 9 attached to tank 1. This is typically a multilayer device with integral sensor, 12. Such a device is described by Hildebrand in "Low-Voltage Bender Piezo Actuator," U.S. patent application, Ser. No. 08/057,944 filed May 5, 1993, incorporated by reference herein. FIG. 11 shows the wiring configuration for a two layer device; however, many layers typically are used. The piezoceramic is suitably coated for environmental protection. The sensor can be a microphone or an accelerometer, or a combination of the two. The signal from these sensors would typically be filtered in such a way that the signal represents a far-field sound pressure measurement (unless both an accelerometer and a microphone are used, in which case the filtered signal represents the sound intensity).

Figure 12:
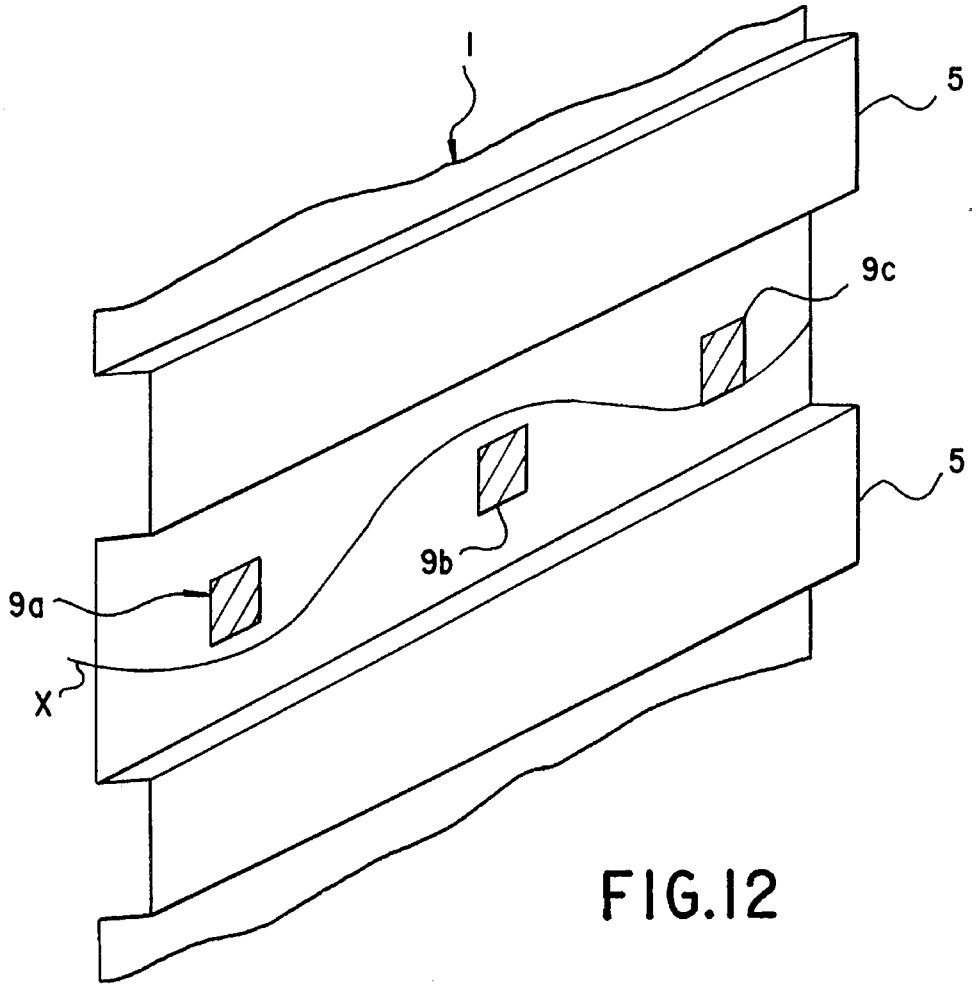
FIG. 12 shows a cut-away view of a tank wall showing two horizontal ribs. Also shown is a typical scheme for locating the piezo-actuators on the tank wall.

Once it has been determined from base-line testing which tank modes are the primary acoustic sources, these tank modes can be controlled using properly-placed piezoceramics for the second and higher-order modes. When the piezoceramics are placed on the tank, the tank becomes an active enclosure for the transformer (or reactor) core. FIG. 12 shows the method for placing the piezo-actuators on the tank. FIG. 12 shows a portion of the transformer tank 1 between two ribs 5. Superimposed on the tank is an operating-deflection-shape x typical of what might be measured for the second harmonic. Let's assume that the baseline testing has shown this operating deflection shape is occurring at the second harmonic, and that it is a significant acoustic source. Piezoceramics 9*a*, 9*b* and 9*c* are placed at the center of each area of maximum dynamic strain energy. An actuator may not be required for each half wavelength—sufficient control authority often can be obtained using the single piezoceramic 9*b* depending on how hard the tank is being driven by the core.

If the resonant frequency of the tank mode being excited is close to a harmonic of the excitation frequency, then the tank mode will appear as a standing wave with opposite half wave lengths 180° out of phase. This is the case illustrated in FIG. 12. The piezoceramics 9*a*, 9*b* and 9*c* can then be tied to the same control channel, with the leads to the middle actuator (9*b*) reversed to obtain the 180° phase shift. If the resonant frequency of the tank mode being excited is not close to a harmonic of the excitation frequency, then the tank mode will appear as a traveling wave with each half wavelength having a slightly difference phase. Then each piezoceramic 9 must be tied to a different control channel.

Note that the piezoceramics for this active enclosure typically consume very little power—less than 25 watts, and more typically less than 5 watts.

Typically piezoceramics will not provide adequate control authority for tank modes near the fundamental excitation frequency (120 Hz). This likely is due to a volumetric change in the core at the fundamental frequency, together with the incompressibility of the transformer oil. For this case, active panels are more effective than active enclosures. The compressible air between the active panel and the tank sufficiently decouples the actuator so that control-authority is not a problem.

Figure 13:
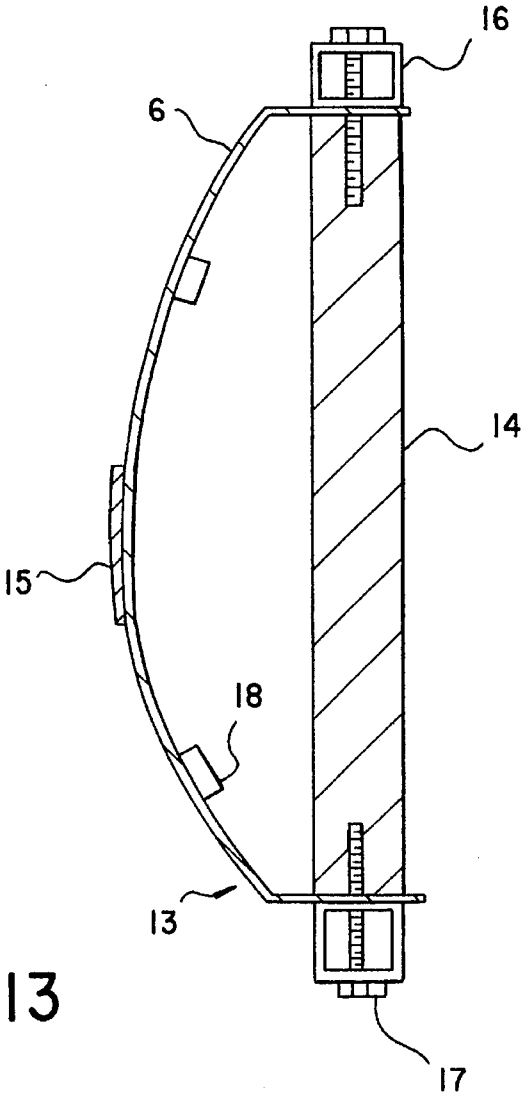
FIG. 13 is a cross-sectional view of one configuration of an active panel.

A cross-sectional view of a preferred embodiment of an active panel is shown in FIG. 13. Item 13 is a panel sheet with a slight curvature, made out of metallic or non-metallic material preferably with low structural damping. The curvature is provided since it is dimensionally more stable than a flat panel—thus it is easier to tune and keep tuned. This sheet 13 is clamped to a flat plate 14 using square tubes 16 and fasteners 17.

Figure 14:
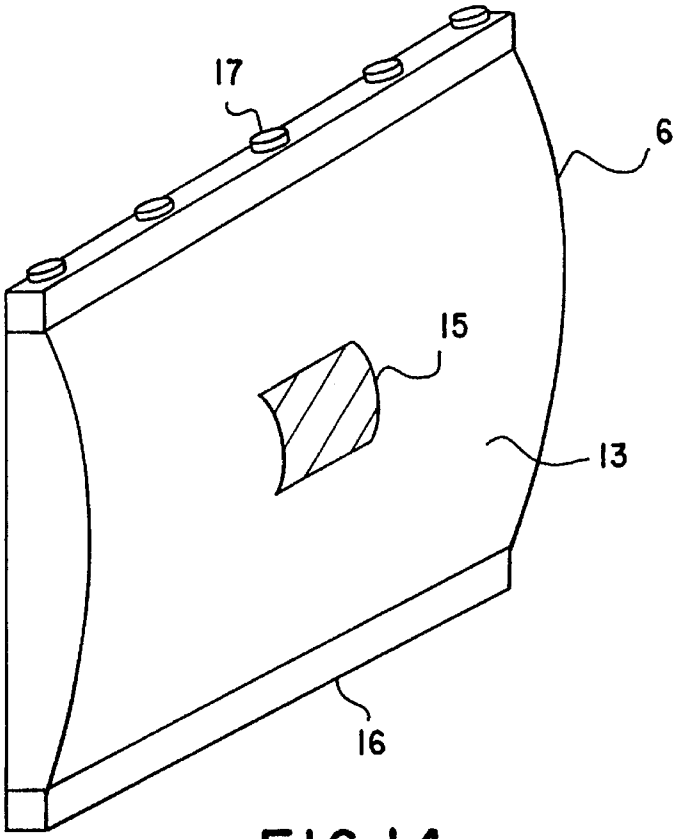
FIG. 14 is a perspective view of one configuration of an active panel.

Another view of the active panel is shown in FIG. 14. The curved sheet is driven with a piezoceramic actuator 15 which has been attached such that it assumes the curvature of the curved sheet. Since the tones produced by the transformer are stationary, the active panel can easily be tuned to increase acoustic output. The sides of the panel are baffled in the preferred embodiment.

The preferred tuning method is shown in FIG. 15 which shows the curved sheet as flat for illustration purposes only. Superimposed on the flat sheet are the mode shapes to which the device is tuned. The dimensions of this sheet 13 are selected such that the (0,3) mode of FIG. 15*a* is excited when actuator 15 is driven at the fundamental resonance frequency of 120 Hz. The (1,3) mode is another effective anti-noise source; this mode shape is illustrated in FIG. 15*b*. Tuning the panel for the (0,3) mode to be at the fundamental excitation frequency of 120 Hz will result in the (1,3) mode being at a greater resonance frequency than the second harmonic (i.e., greater than the desired 240 Hz). However, the resonance frequency for the (1,3) mode can be lowered to the desired frequency (240 Hz) without affecting the (0,3) mode by placing weights 18 (see FIG. 13) along the nodal lines for the (0,3) mode where the peaks for the (1,3) mode are located. Using this approach to tune the panel, very little power is consumed by the panel when canceling transformer noise—typically less than 5 watts per panel, and often as little as 50 milliwatts per panel. This active panel arrangement is preferred to conventional loudspeaker designs because the distributed nature of the active panels couples much better with the distributed nature of the tank noise, and the piezoceramic driver 15 and sheet 13 are inherently more reliable than a moving coil and speaker cone. The active panel is fundamentally robust in design—it can easily be designed to be used outdoors exposed to the elements for many years without failure.

Interaction of the active panel with the transformer tank is illustrated in FIG. 16. FIG. 16 shows a section of the transformer tank 1 together with rib 5, with an operating deflection shape typical of the first harmonic shown with dashed lines. Also shown is an active panel 6, with the operating-deflection-shape typical of the first panel resonance. The phase relation between the tank and the active panel is clearly indicated—as the tank is a volumetric source, the active panel is a net anti-volumetric source. The error microphone 10 is sandwiched between the tank and the active panel, and the sound pressure level at the desired frequencies is minimized at this location. In this way, the active panel can absorb acoustic energy before it is radiated to the far-field.

This microphone/active panel arrangement is preferred for several reasons. First, placing the sensor near the tank ensures a high signal-to-noise ratio (thus limiting problems with noise such as those due to wind) and reduces cross terms between curved panels. Second, this arrangement results in global cancellation in the far-field even though the microphones are located very close (usually less than an inch) from the transformer surface. The curved panel can also cancel higher order harmonics. This results in fewer actuators since the active panel can now take the place of piezoceramics on the tank. For this case, a microphone location external to the active panel also may be required.

Using the actuators discussed above, an active control scheme was developed for the transformer shown in FIG. 2. Active panels were mounted on the tank over acoustic "hotspots" for 120 Hz noise. The active panels also were used to cancel any 240 Hz sources for which they coincidentally happened to be properly located. The remaining 240 Hz noise sources were canceled using piezoceramics attached directly on the tank. The actuator placement for the east and north sides of the tank is shown in FIGS. 17 and 18.

Piezofilm can be used instead of microphones or accelerometers to sense far-field noise (with appropriate signal filtering). Alternately, a pair of microphones (or an accelerometer plus a microphone) can be used to sense intensity (with appropriate signal filtering) as the error signal to be zeroed rather than sound pressure or tank acceleration.

Still another view of a transformer tank 1 is shown in FIG. 19. Here the transformer is mounted on supports which result in the bottom of the transformer tank being an acoustic source (in addition to the top being a potential acoustic source). FIG. 19 shows piezoceramics 9 being attached to the top, bottom, and bottom-supports of the tank 1, resulting in the top, bottom and bottom-supports becoming part of the active enclosure. Active panels 6 are also shown at the top and bottom of the transformer 1. Also shown in FIG. 19 is a radiator bank 20. If the radiator bank is an acoustic source, piezoceramics with integral sensors 9 can be attached to control the fin vibration. Alternately, inertial shakers such as 21 attached to the radiator fin can be used to control vibration. In addition, these piezoceramics or shakers on the fins can be used to drive the radiator fins as loudspeakers, with external microphones or intensity probes used as error sensors.

Operation of the "Global Quieting System for Stationary Induction Apparatus" is as follows as illustrated in FIG. 20. This particular control arrangement embodies a multiple-interactive, self-adaptive controller as discussed by Tretter (U.S. Pat. No. 5,091,953 incorporated by reference herein). For this example, the controller is "personal computer" (PC) based. This controller, built by Noise Cancellation Technologies, Inc. allows up to 64 inputs and up to 32 outputs. The inputs and outputs are fully coupled. Operation is such that the line voltage from any local 120 volt outlet is stepped down to about 1 volt using transformer 23 and sent to a processor board 25 in the PC based controller. This reference signal, 24 is related to the frequency content of the noise to be canceled. The reference signal 24 is also highly coherent with the output of the microphones (or other) error sensors.

The sound pressure level adjacent to the tank is measured by the microphones 10. The microphones convert the sound pressure to voltage signals which are routed to junction box 32 adjacent to the transformer. The error sensor signals are then routed by trunk cable to input filters 36 which are located in the control building in the substation yard. The filtered error-sensor signals are then sampled with Analog-to-Digital converters, 37 and sent to the processor board, 25. The digital error-sensor signals are then used in conjunction with the reference signal 24 and a filtered-X update equation in the processor board 25 in order to adapt or change the coefficients of adaptive digital filters in 25 and generate output signals which minimize the error-sensors as far as possible. The digital output signals from the processor board 25 are sent to Digital-to-Analog converters 27. The analog output signals are amplified by amplifiers 29 (powered by power supplies 30) and are routed by trunk cable from the substation building to the junction boxes 31 at the transformer. The amplified output signal is next routed to the active panels 6 and actuators 9 on the tank. The actuators 9 on the tank thereby cancel acoustically-radiating modes on the tank which are excited by the second harmonic of the excitation frequency (240 Hz). The active panels 6 on the tank thereby cancel noise radiated by acoustically-radiating modes on the tank which are excited by the fundamental excitation frequency (120 Hz). To decrease the number of actuators and control channels, the active panels 6 on the tank may also cancel noise radiated by modes on the tank which are excited by the second harmonic of the excitation frequency. The error sensors (shown as microphones 10 in FIG. 20) must be positioned near the transformer in a manner such that there is a large global reduction in the far-field. The PC based controller includes a modem (38) to allow remote communication and operation of the controller.

Note that for this system to work properly, terms in the transfer function matrix at 120 Hz typically must be zeroed for the piezoceramics on the tank, otherwise the signals to these actuators will include a 120 Hz component which will soon clip (due to the low control authority of piezoceramics on the tank at 120 Hz).

Large global reductions in far-field transformer noise were measured when the system described above was installed on the transformer, the tank for which is shown in FIG. 2. For example, reductions of 15 dBA were measured for the first and second harmonics. FIG. 21 shows the control-off/control-on performance of the system by transformer side for the 120 Hz tone. FIG. 22 shows the control-off/control-on performance of the system by transformer side for the 240 Hz tone. These measurements were made 10 meters from the transformer using a Bruel & Kjaer sound level meter with a one-third octave band filter. These measurements of sound reduction were limited by the background noise level in the vicinity of the sound level meter. Greater reductions were measured with lower background levels. For example, reductions of up to 28 dBA were measured for the first harmonic with low background noise-levels as would occur in residential areas at night or in the early morning. Note that the performance of the quieting system does not change with the background noise, because there is ample single-to-noise with the error microphones close to the transformer tank. It is only the perceived reduction measured by the sound level meter which varies with the background noise level.

The power consumed by the active control system is minimal. The most power measured for an actuator is 5 watts. Typical power consumption is 1 watt per actuator. Thus even for 50 actuators, total power consumption would be much less than 1 kilowatt. Thus power consumption by the system is not a problem.

Note for the active-control setup, all actuators and sensors are either on or immediately adjacent to the transformer. Thus there are no actuators or sensors in the yard where they are susceptible to damage or interfere with maintenance or repair at the substation.

Older existing transformers are particularly noisy. Substations in residential areas with these transformers installed typically do not meet current laws for property-line noise limits, and are often a source of complaints for utilities. There is often enough land area in these substations that newer, lower noise transformers would meet property-line noise limits. However, the older transformers may have decades of useful life remaining. Replacing the transformers strictly to lower noise is very expensive. Building passive enclosures around the noisy transformers is nearly as expensive. However, installation of the invention described herein allows transformer noise to be reduced to much lower levels at a fraction of the cost of transformer replacement or building a passive enclosure.

There are two types of losses in a transformer: winding losses and core losses. Most of the losses are in the windings, and these are easily reduced by adding winding material, with little increase to the overall size and weight of the transformer. However, the primary means available to the manufacturer to decrease noise is to decrease the electromagnetic flux density in the core (i.e., increase the core material). This results in substantial increase to the size and weight of the transformer. So the manufacturer decreases losses while decreasing noise by adding core material, with substantial increases in the size, weight and cost of the transformer. If noise were not a concern, the transformers could be built smaller, lighter, and with low losses (i.e., lower cost). Lower size and weight also mean easier shipping and a smaller foundation, which translates to lower cost.

High anoise levels from transformers often result in utilities locating substations in industrial areas, near highways, or other areas where transformer noise is less of a nuisance. Utilities prefer to locate transformers close to the end-user in order to reduce their line losses. When utilities locate transformers in residential areas, they typically must buy large tracts of land (to use distance to reduce the effective noise from the transformer) and/or buy expensive low noise transformers, or buy regular transformers and surround them with expensive passive enclosures.

The invention claimed herein not only decreases transformer noise to background levels, but also holds promise to radically change how transformers and electrical distribution networks are designed and built, to allow more compact substations and more efficient networks, potentially lowering overall network cost.

We claim:

1. A quiet stationary induction apparatus comprising:

induction means, a tank means surrounding said induction means so as to provide a space therebetween, a fluid medium in said space, said induction apparatus adapted to produce vibration phenomena in said medium and on said tank means, an active noise attenuation means including a control means associated with said tank means and adapted to produce counter vibration phenomena in an acoustically coupled fashion to thereby attenuate noise resulting from said vibration phenomena, said active noise attenuation means including an actuator means located adjacent said tank means including curved surface actuators having their curved surface facing standing wave forms of vibration phenomena on said tank means, and an accompanying sensor means associated therewith for sensing the residual signal resulting from the interaction of said vibration phenomena and counter vibration phenomena, said sensor means including first sensors located approximately midway between said tank means and said curved surfaces, said actuator means including piezoceramic actuators mounted on said tank means over localized areas of high vibration, and said sensor means further including second sensors located on said piezoceramic actuators to thereby provide residual signals to said control means to enable it to attenuate both standing wave forms and localized areas of high vibration phenomena.

2. A method of quieting stationary induction apparatus using active noise cancellation techniques, said method comprising:

measuring the areas of maximum deformation adjacent said apparatus caused by vibratory phenomena, placing actuator means in those areas of maximum deformation including placing large actuator means adjacent areas where the deformation phenomena takes on the shape of a standing large wave form, and placing small actuator means adjacent areas having a local deformation phenomena, hooking said small actuators together electronically into one channel, and activating said actuator means so as to cause counter and opposite vibratory phenomena to thereby attenuate said deformation and quiet said apparatus.

3. An active noise attenuation system for controlling vibration phenomena produced by a stationary induction apparatus, said system comprising:

adaptive controller means with control channels for generating control signals, active acoustic actuator means having a sound radiating surface operatively connected to said controller means and adapted to be placed adjacent said stationary induction apparatus for controlling said vibration phenomena by emitting counter vibration phenomena derived from the control signals into the acoustic space between said sound radiating surface of said acoustic actuator means and said apparatus, and acoustic sensor means located in the acoustic space between said acoustic actuator means and said apparatus and operatively connected to said adaptive controller means for providing error sensor signals thereto to constantly update the attenuation process.

4. A system as in claim 3 wherein said acoustic actuator means include panels which are curved in one direction and flat in the other direction wherein said counter vibration phenomena are caused by flexural vibrations in said panel.

5. A system as in claim 4 in which the curved surface of said panel is directed to face the surface of said apparatus.

6. A system as in claim 3 and including vibration actuator means attached to the surface of said apparatus.

7. A system as in claim 6 and including vibration sensing means attached to the surface of said apparatus, said vibration sensing means being operatively connected to said controller for providing error sensor signals thereto to constantly update the attenuation process.

8. A system as in claim 6 wherein said vibration actuator means comprises piezoceramic actuators attached to said apparatus on areas producing localized high vibration.

9. A system as in claim 8 wherein said sensor means includes accelerometer means mounted on said piezoceramic actuators.

10. A system as in claim 6 in which said acoustic actuators are used to control said vibration phenomenon in a prescribed low frequency range and said vibration actuators are used to control said vibration phenomenon at other frequencies.

11. A system as in claim 3 and including additional acoustic sensors in a region removed from said acoustic actuators and said apparatus.

12. A system as in claim 11 in which said additional acoustic sensors are acoustic intensity probes.

13. A system as in claim 6 in which a plurality of said vibration actuators are electronically linked to a single channel of said controller.

* * * * *